United States Patent [19]

Zelina et al.

[11] Patent Number: 4,459,516

[45] Date of Patent: Jul. 10, 1984

[54] LINE OPERATED FLUORESCENT LAMP INVERTER BALLAST

[76] Inventors: William B. Zelina; Francis J. Zelina, both of 6410 W. Ridge Rd., Erie, Pa. 16506

[21] Appl. No.: 392,004

[22] Filed: Jun. 25, 1982

Related U.S. Application Data

[63] Continuation-in-part of Ser. No. 280,866, Jul. 6, 1981, abandoned.

[51] Int. Cl.[3] ..... H05B 37/02

[52] U.S. Cl. ..... 315/209 R; 315/219; 315/223; 315/244; 315/276

[58] Field of Search ..... 331/113 A; 315/DIG. 7, 315/219, 209, 219, 223, 244, 276, DIG. 7

[56] References Cited

U.S. PATENT DOCUMENTS

| | | | |
|---|---|---|---|
| 3,155,875 | 11/1964 | Wenrich et al. | 315/189 |
| 4,045,711 | 8/1977 | Pitel | 315/239 |
| 4,109,307 | 8/1978 | Knoll | 315/247 |
| 4,188,661 | 2/1980 | Bower | 315/224 |
| 4,277,728 | 7/1981 | Stevens | 315/DIG. 7 |
| 4,353,009 | 10/1982 | Knoll | 315/277 |

*Primary Examiner*—Harold Dixon
*Attorney, Agent, or Firm*—Charles L. Lovercheck; Wayne L. Lovercheck; Dale R. Lovercheck

[57] ABSTRACT

Applicant has provided a ballast circuit for fluorescent lights made up of the combination of (1) a source of electrical energy, (2) a resonant circuit, (3) a switch means for connecting the source of electricity to the resonant circuit, (4) means to connect the resonant circuit to a load, (5) a resonant current monitor controlling the switch means in synchronism with the resonant current so that the switch means switches the resonant current when the resonant current passes through zero.

The resonant current monitor is a current transformer having a primary winding connected in series with the resonant circuit and two secondary windings connected to the bases of the two switching transistors in a two transistor inverter circuit at a polarity that will switch one of the transistors on and the other off at the time current passes through zero. This is the optimum time to switch the transistors since the current flowing through the transistors is passing through zero at that time and therefore the transistors operate at maximum efficiency and there are minimum switching losses and improves the efficiency of the circuit. The circuit will automatically adjust the switching frequency to the changed resonant frequency should the value of the inductor or the capacitor degrade and therefore change, and the switching losses will therefore be maintained at minimum.

14 Claims, 10 Drawing Figures

LINE OPERATED FLUORESCENT LAMP INVERTER BALLAST

REFERENCE TO PRIOR APPLICATIONS

This Application is a continuation in part of Pat. application Ser. No. 280,866 filed July 6, 1981 now abandoned.

REFERENCE TO PRIOR ART

The Wenrich Patent discloses a load T2 connected in parallel with the series-parallel circuit made up of transformer T1 and capacitor C6. T1 and C6 like any other inductive-capacitance circuit could be designed to resonate at some frequency, using the familiar equation $$f = \frac{1}{2\pi\sqrt{LC}},$$

however the Wenrich circuit would not function as designed if it was designed to resonate and such design to resonate could only be done in view of Applicant's disclosure viewed in retrospect since Wenrich does not teach resonants but to the contrary teaches a inductor that will saturate and provide a surge of current which will trigger the transistors.

The Engel inverter frequency is controlled by the timer made up of the winding 24a and resistors 26 while Wenrich's circuit operates off an inductance which saturates and the capacitor limits the current flow when at the point the circuit saturates so that the inverter switches when the current through the inductance and capacitance is maximum. This is exactly the thing that Applicant is attempting to avoid and is exactly opposite from Applicant's circuit operation.

Both Wenrich and Engel will switch when the inverter has substantial current flowing and not as the current passes through zero. Neither Engel nor Wenrich provide a resonant current monitor for the resonant circuit current for controlling the switching means.

U.S. Pat. No. 3,753,076 shows an inverter ballast circuit which utilizes the energy stored in a resonant circuit to reduce input current to a value near zero during switching. U.S. Pat. No. 4,023,067 shows an inverter circuit that provides minimum switching losses by use of resonant storage techniques and a unique feedback system. It attempts to promote zero current switching. The present circuit assures zero current switching.

U.S. Pat. Nos. 4,031,454, 4,245,177, 4,279,001 and 3,179,901 show the state of the art but are not relevant to the claims herein.

BACKGROUND OF THE INVENTION

General

The superior lumen per watt characteristic of fluorescent lamps has for decades prompted research on ways to operate these lamps from a DC supply. These applications included the transportation industry (trains, transit cars, buses and airplanes) and the portable lighting industry. In these applications, no AC power is available and therefore the premium cost of these inverter ballasts was justified since the only alternate light source was the incandescent lamps (about 15 lumens per watt). When compared with fluorescent lamps of about 50 lumens per watt and about 10 times the life, the additional inverter ballast cost was justified.

It has been demonstrated as early as the early 50's, that the fluorescent lamp, when properly operated at frequencies above 15 KHZ, would demonstrate about 15% improvement in the output lumens per watt over 60 HZ operation. This well recognized fact, plus the present impetus on energy saving, has been the driving force behind multi-million dollar research and development efforts to apply high frequency lighting to commercial, industrial, and consumer applications. To date, there has been limited success in this effort. The reason for this record can be understood by studying the complexity of the problem added to the economics of the situation. Many efforts produced costs many times that of the 60 HZ Ballast counterpart with efficiencies, or ballast losses comparable or worse than the 60 HZ Ballast. Further, 60 HZ Ballast manufacturing has generally responded with better steel and more copper to improve their efficiency.

The Problem

The problem of making High Frequency available for general fluorescent lighting can be defined in the following categories:

A. Efficiency - must approach 95%. This makes payback an economic reality.

B. Cost - The cost of the High Frequency Ballasts must be no more than 2 or 3 times the cost of the 60 HZ Ballast.

C. Reliability - The inverter ballast must match or better the 60 HZ Ballast.

D. Life - Typical life must exceed ten years.

Many of the above problems are interdependent. For example, 95% efficient means extremely small losses and therefore low temperature rise, which generally means high reliability and long life. However, generally, cost tends to increase when the above objectives are addressed. We can then summarize our problem statement by saying the following: We must find a solution, if one exists, that will demonstrate the high efficiency and low loss with primary effort on production simplicity and low costs.

Solution to Problem

It has been generally accepted by these inventors since their first lighting of a fluorescent lamp with an inverter ballast, in the mid 50's, that resonance plays a dominant factor in ballast efficiency. However, maintaining resonance with component tolerances in production and during aging of the ballast appeared to be an impossible problem. In 1970, during work on the Coleman Camping Lantern ballast, the inventors were successful in providing resonant feedback which solved the above problem and produced efficiencies approaching 90%. This technology is used extensively in the transit industry and is the basis of Pat. No. 3,753,076. Following this work, a single transistor resonant feedback ballast was developed which approached 95% efficiency. This technology is the basis for most of the low voltage camping lantern ballasts made today, for example, Pat. No. 4,023,067. The resonant feedback promotes zero current switching of the transistor thereby providing the high efficiency.

The teaching contained herein goes an order of magnitude further in that, instead of promoting zero current switching, it assures it. Further, the start up transient is addressed in such a manner that the switching devices are less stressed during start up. Still, the above solutions have been accomplished in such a manner that a cost effective solution has been demonstrated. The 25% to 30% overall energy savings with no change in light output can easily justify the higher inverter ballast cost. Retrofitting field ballast should be possible with an approximate one year payback, depending upon local energy and labor costs.

The operation of the inverter in synchronism with the resonant current also automatically adjusts the switching frequency to the resonant frequency should the value of the inductor or capacitor degrade and therefor change. The switching losses will therefore be maintained at a minimum.

SUMMARY OF INVENTION

The solution to the problem discussed will be described using FIG. 1 through FIG. 4. Before we start, we should review our knowledge of simple series resonant circuit operation. It should be recalled that in a simple series resonant circuit the voltage across the capacitor will be 180 degrees out of phase with the inductance and the current flowing will be 90 degrees out of phase with both the capacitor and inductor voltages ignoring leading and lagging relationships. With reference to FIG. 1, one skilled in the art can determine relative relationships of the electrical quantities without experimentation. Note also that when current $I_r$ (resonant current) goes through zero, the stored energy in condenser 22 (C) is a maximum ($\frac{1}{2}$ $CV^2$) and the stored energy in (the reactance 14 and 18) L is at zero ($\frac{1}{2}$ $LI^2$).

If we can inject energy into the tank as $I_r$ goes through zero, 11 will switch at zero current and conduct a half sine wave of current into the LC tank circuit. If, as $I_r$ goes through zero, we turn 11 off and 12 on, we take the stored energy in Condensor 22 and transfer it in reverse polarity to Condensor 22. In this fashion, we continue to increase stored energy and voltage (the same) in the tank circuit. If energy is not removed from the resonant tank, voltages (energy) will build to component destruction.

Now, we must address ourselves to a better understanding of gas arc lamps (fluorescent lamps). Their general characteristic is such that an arc ionization voltage of about 2 to 3 times the operating voltage is required. If we couple the fluorescent lamp into the tank circuit by a second winding on inductor 17, see FIG. 1, the lamp will ionize and then the voltage will stabilize at the operating arc voltage of the particular lamp used. The tank circuit via transistor 11 will accept exactly the energy each cycle that the lamp removes for operation. Further, since heating energy is only required for starting, we can see that starting to operate cathode heater watts are about 4 to 1, and up to 9 to 1 (square of starting and operating cathode heater voltage). This is a very desirable characteristic since it conserves energy during operation, thus providing the maximum possible lumens per input watt.

Further, we should consider the fluorescent lamp characteristic. It is such that the lumen efficiency is adversely affected by form factors drastically different from a sine wave. (Peak to RMS ratio). Because of the sinusoidal operation of the tank circuit we deliver a very acceptable wave shape to the lamp. This further improves lumen efficiency over other inverter ballast approaches.

OBJECTS OF THE INVENTION

It is an object of the invention to provide an improved combination inverter circuit, resonant circuit and resonant current monitor for operating the inverter.

Another object of the invention is to provide a combination inverter circuit, resonant circuit, resonant current monitor and means to connect the combination to a load and means to switch the resonant current in the inverter circuit in synchronism with the resonant current as the resonant current passes through zero.

Another object is to provide a solid state ballast which is simple in construction, economical to manufacture and simple and efficient to use.

Another object of the invention is to provide an improved solid state ballast.

With the above and other objects in view, the present inventon consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

Figure 7:
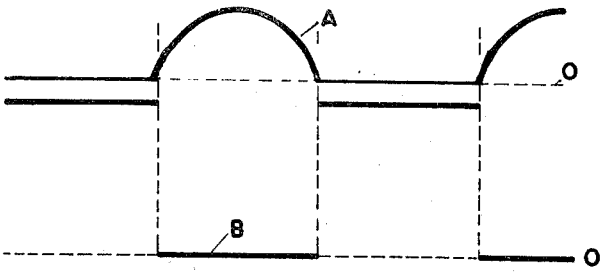

FIG. 7, curve A showing the wave shapes of the collector current through the transistor 11 and curve B showing the collector-emitter voltage of transister 11.

Figure 8:
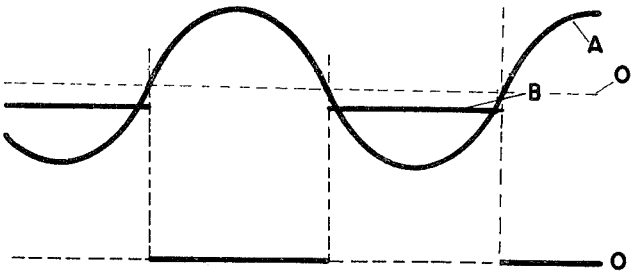

FIG. 8, curve A, is a curve showing the resonant current in transistor 11 and curve B is showing the collector-emitter voltage of transistor 11.

Figure 9:
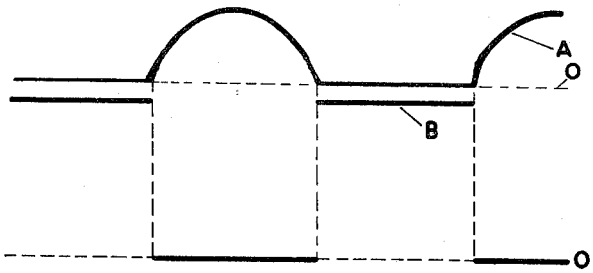

FIG. 9, curve A, is a curve showing the collector-emitter current in the transistor 12, curve B is a curve showing the collector-emitter voltage in transistor 12.

Figure 10:
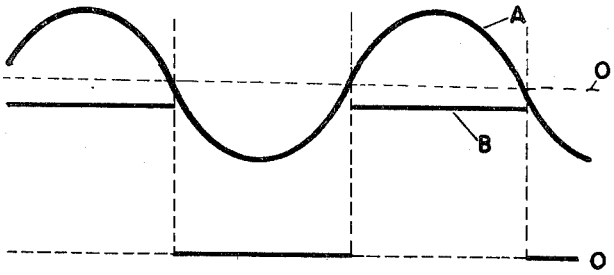

FIG. 10, curve A, is a curve showing the resonant current of transistor 12 and curve B is a curve showing the collector-emitter voltage of transistor 12.

DETAILED DESCRIPTION OF THE DRAWING

The purpose of this invention is to provide an efficient inverter ballast circuit for powering a fluorescent lamp from a standard sinusoidal line voltage source. The inverter ballast will operate at a high frequency, above the human audible range; which eliminates the problem of noise, increases the efficiency of lamp operation, and decreases component size and subsequent cost and switches the transistors which control the current in the resonant circuit as the current in the resonant circuit passes through zero and in synchronism with the transistors.

The Resonant Oscillator

The oscillator used to generate a high frequency voltage for driving the fluorescent lamp 55 is a two transistor resonance maintenance circuit connected to a series resonant circuit. The entire circuit is made up of five elements, (1) a source of electricity, (2) a series resonant circuit designed to resonate at a predetermined frequency, (3) a switching means connecting the resonant circuit to the source of electricity, (4) a resonant current monitor means for actuating the switching means, and (5)means for connecting a load to the resonant circuit.

Since it is the current flowing in the resonant circuit that commands the transistor to switch, it is axiomatic that the command will be in synchronism with that current and irrespective of the values of the inductance and capacitance (within wide frequency limits) the circuit will always operate at resonance. The transistors will switch in synchronism with that resonant current.

The only limitation on zero switching is not in the circuit itself, but may result from limitations in the transistors themselves in the form of a delay in transistor switching due to electrical charges stored in the transistor and to a very minor degree limitations in the current transformer. With high quality transistors and high quality current transformers, the transistors would switch exactly at zero irrespective of the values of the inductor and the capacitor within design limits. Applicant's test shown in the sketches reproduced in the drawings and supported by the attached Affidavit, show that even with commercially available components, the transistors switch at zero insofar as can be determined from ordinary laboratory equipment. Applicant has attempted to claim this zero switching as occurring "as the resonant current passes through zero". This is intended to cover variations from zero that may occur with commercially available components which is indistinguishable in the test Applicant has made.

The source of electricity may be any suitable source of direct current and it can be 120 volt AC circuit connected to the switching means through a full wave rectifier as shown or any other suitable source of direct current.

The switching means may be any suitable electronic valve such as a transistor with a control element connected to the resonant current monitor. The capacitor C22 may have a value of 0.081 microfarads and the inductance may have a value of 4.7 millihenries. The transformer 13 may be a suitable ferrite core transformer. The transformer 13 has a core magnetically connecting to the primary winding 18 and to the secondary windings 19, 20 and 21. The current transformer has a suitable ferrite core which may be in the form of a ring on which the windings are wound as shown.

When power is applied to the input terminals, 66 and 68 of the full-wave rectifier 27, the input voltage is filtered by the capacitor 21, this DC voltage is applied to the network which includes transistors 11 and 12, causing transistor 11 to turn on. This causes capacitor 22 to start charging through primary winding 14 and primary winding 18. The primary winding 18 of the high leakage reactance transformer 17 is magnetically coupled to secondary windings 19, 20 and 21. Secondary winding 20 is used to drive the fluorescent lamp 55 which is of the ionizable gas type lamp.

The transformer 13 is a current transformer used to sense current flow in the resonant loop made up of primary winding 14 and primary winding 18 and condensor 22 and to synchronize the switching of transistors 11 and 12 with the resonant current. A current transformer as used herein is one having a primary winding connected in series with a circuit carrying a current and the said primary winding carrying said current wherein the primary winding is a few turns, that is a small number of turns. When current is flowing into the terminal 44 (dots on the drawing indicate instant polarity at a given time) current is flowing out of terminal 40 because the windings of transformer 13 are magnetically coupled. This turns transistor 11 on and turns transistor 12 off. When condensor 22 becomes fully charged, current flow passes through zero and reverses in the resonant loop. This reversal of current is sensed by the current transformer 13 which turns off transistor 11 and turns transistor 12 on. Capacitor 22, through resonant action will transfer its charge to the opposite polarity, again causing current to pass through zero and reverse in the capacitor 22 loop. This second reversal is sensed by transformer 13 which turns transistor 11 on and turns transistor 12 off. With commercial tolerance components the switching may occur slightly off the zero current point but with precise tolerance components the switching will be exactly at zero. The phrase "when passing through zero" is intended to mean switching at essentially zero which was, in tests made on the circuits tested by Applicant, as closely as can be determined from the photographs from which FIGS. 7 through 10 were taken.

Transistors 11 and 12 are now maintaining resonance in the capacitor 22 loop. This oscillating current and the subsequent voltage generated by this charging and discharging of capacitor 22 generates a voltage in primary winding 18. This voltage can be either stepped up or down, to meet the requirements of any size fluorescent lamp connected to the output of secondary winding 20.

The resonant frequency of the oscillator is set by the size of capacitor 22 and the inductance of primary winding 18. The ratio of turns of primary winding 18 to secondary winding 20 is utilized to reflect the fluorescent lamp load impedance into the primary circuit in order to dampen the primary circuit.

The Lamp Output

Prior to lamp ionization, current is applied to the cathodes of the windings 19 and 21 for heating purposes. This feature improves lamp life for virtually no cost. During this mode the lamp is in a high impedance state, the high impedance allows the secondary winding 20 voltage to be high. Because the voltage of winding 20 is high, the voltage of winding 19 and the voltage of winding 21 are high enough to generate substantial heating current in the lamp filaments. When the lamp 55 becomes ionized or turns on, its impedance becomes low. This low impedance reflected into the resonant loop (damping) forces the secondary voltage to a low value, which in turn forces the voltage on heaters 56 and 61 to a negligible value because of the turns ratio of windings 19 and 21 to the winding 20. The fluorescent lamp 55 is now on with negligible filament heating current flowing. FIGS. 7, 8, 9 and 10 show voltage and current readings taken during the operation of a circuit like the one shown in FIG. 1 of this application. A first sensor was connected to the circuit for measuring current of the collector of transistor 11, another sensor for measuring the current of the collector of transistor 12, a third sensor for measuring the current in the resonant circuit, a fourth sensor for measurement of voltage across transistor 11, a fifth sensor for measuring the voltage across transistor 12. The circuit was operated with the sensors connected to a cathode ray oscilloscope. FIG. 7, curve A shows the wave shape shown by the oscilloscope of the collector current through the transistor 11, curve B, the collector-emitter voltage of transistor 11. FIG. 8, curve A, is a curve showing the resonant current in transistor 11 and curve B is a curve showing the collector-emitter voltage of transistor 11. FIG. 9, curve A is a curve showing the collector-emitter curve current in transistor 12, curve B is a curve showing the collector-emitter voltage in transistor 12. FIG. 10, curve A is a curve showing the resonant current of transistor 12 and curve B is a curve showing the collector-emitter voltage of transmitter 12. In the curves, the vertical axis of the curves shows that the transistors switch when the resonant current (upper curve in all pictures) passes through 0.

Figures 1, 2, 3:
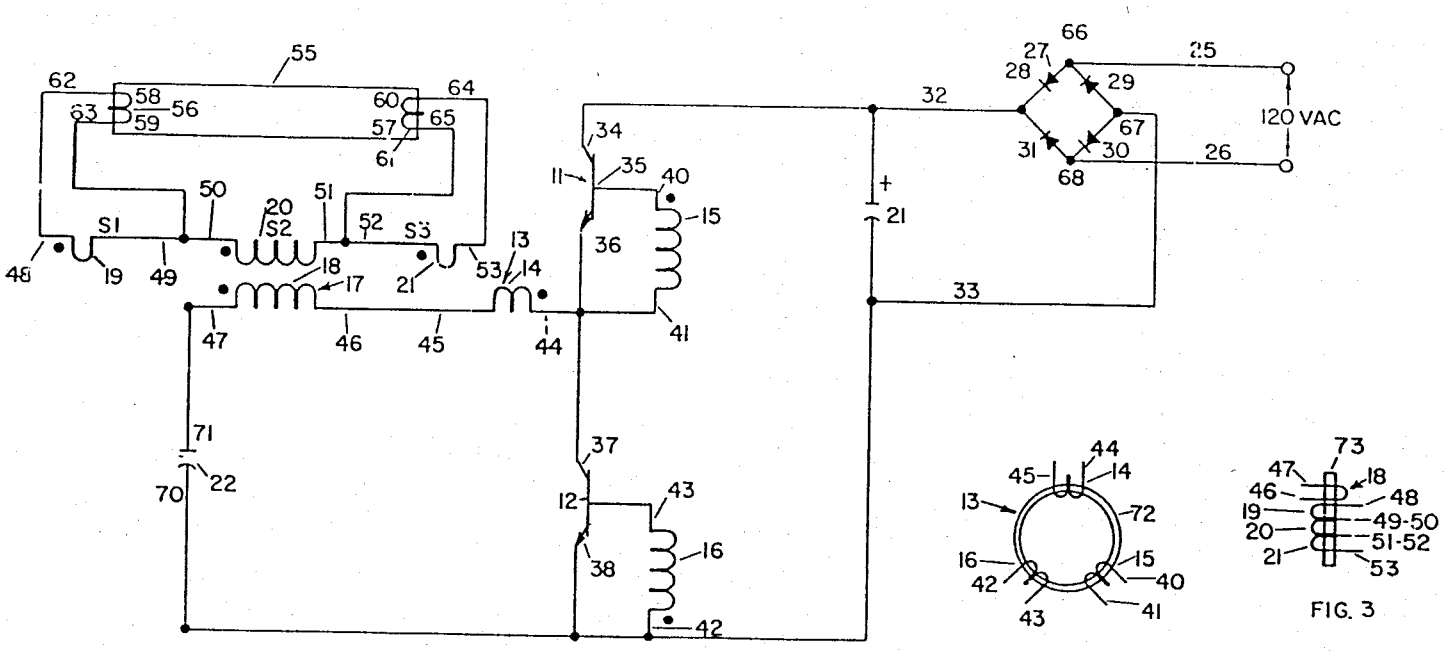
FIG. 1 is a schematic view of the one embodiment of the invention.
FIG. 2 shows a schematic view of one of the transformers.
FIG. 3 shows a schematic view of the other transformer.
Figure 4:
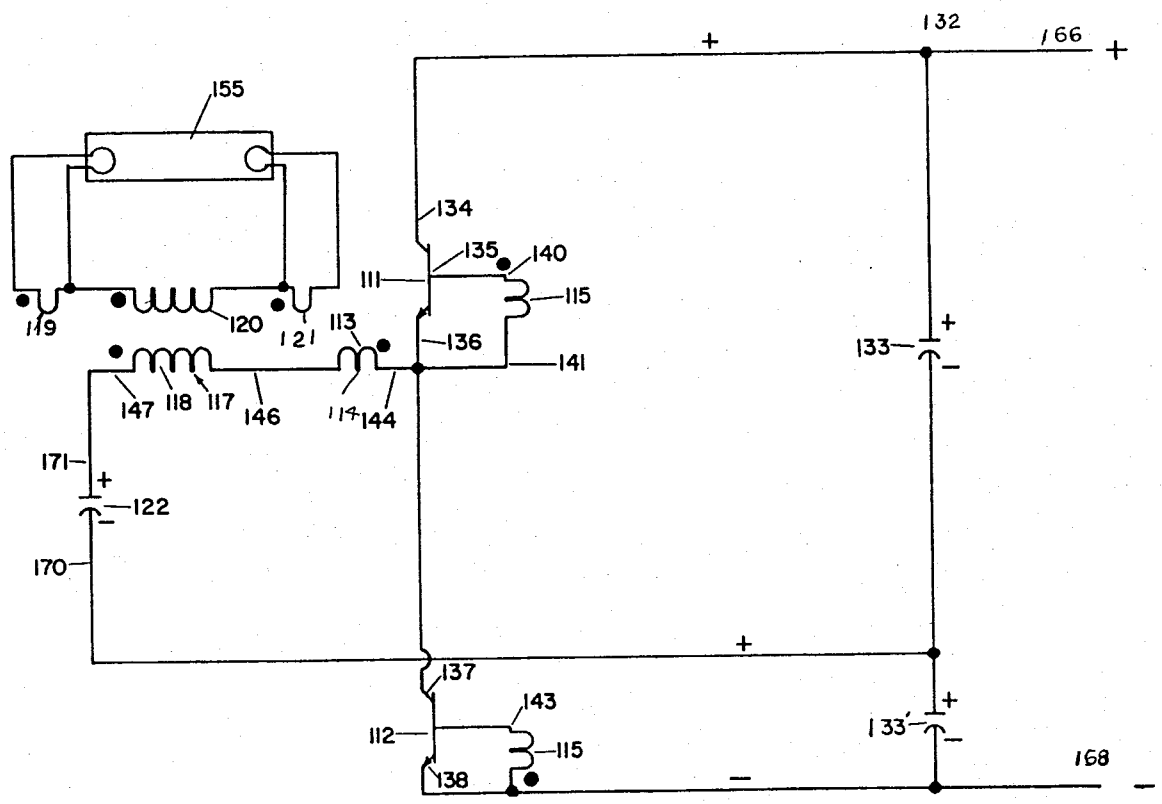
FIG. 4 is a schematic view of another embodiment of the invention.

In the embodiment of the invention shown in FIG. 4, an inverter ballast circuit utilizing the basic principles set forth in the embodiment of the invention in FIG. 1 is shown.

The oscillator used to generate the high frequency voltage for driving a fluorescent lamp 55 includes the two transistor resonance maintenance circuit. When power is applied to the input terminals 166 and 168, input voltage is divided by capacitor 133 and capacitor 133'. Secondary winding 120 on transformer 117 is connected to the fluorescent lamp 155. The resonant loop is made up of the primary winding 114 on the current transformer 113 and the primary winding 118 on the high leakage reactance transformer 117 and the capacitor 122. The DC voltage is applied to the network which includes transistors 111 and 112 causing transistor 111 to turn on. This causes the capacitor 122 to start charging through the primary windings 114 and 118. Primary winding 118 of the high leakage reactance transformer 117 is magnetically coupled to the secondary winding 120. Secondary winding 120 is used to drive the fluorescent lamp 155 which is of the ionizable gas lamp type.

The transformer 113 is a current transformer used to sense current flow in the resonant loop and to synchronize the switching of the transistors 111 and 112. When current is flowing in the terminal 144 (dots on the drawing indicate instant polarity at a given time), current is flowing out of terminal 140 because the windings of transformer 113 are magnetically coupled. This turns the transistor 111 on and turns transistor 112 off. When condensor 122 becomes charged, current passes through zero and reverses in the condensor 122 loop. This reversal of current is sensed by the current transformer 113 which turns off transistor 111 and turns transistor 112 on. Capacitor 122, through resonant action, will transfer its charge to the opposite polarity, again causing current to pass through zero and reverse in the capacitor 122 loop. The second reversal is sensed by transformer 113 which turns transistor 111 on and turns transistor 112 off. Transistors 111 and 112 are now switching in synchronism with the resonant current as shown by FIG. 8 and FIG. 10 maintaining resonance in capacitor 122 loop. This oscillating current and the subsequent voltage generated by this charging and discharging of capacitor 122 generates a voltage in primary winding 118. This voltage can be either stepped up or stepped down to meet the requirements of any size fluorescent lamp connected to the output of secondary winding 120.

The resonant frequency of the oscillator is set by the size of the capacitor 122 and the inductance of primary windings 114 and 118 to reflect the fluorescent lamp load impedance into the primary circuit in order to dampen the primary circuit.

The circuit of the embodiment of FIG. 4 has the beneficial effect described in connection with the other embodiments of the invention.

Figure 5:
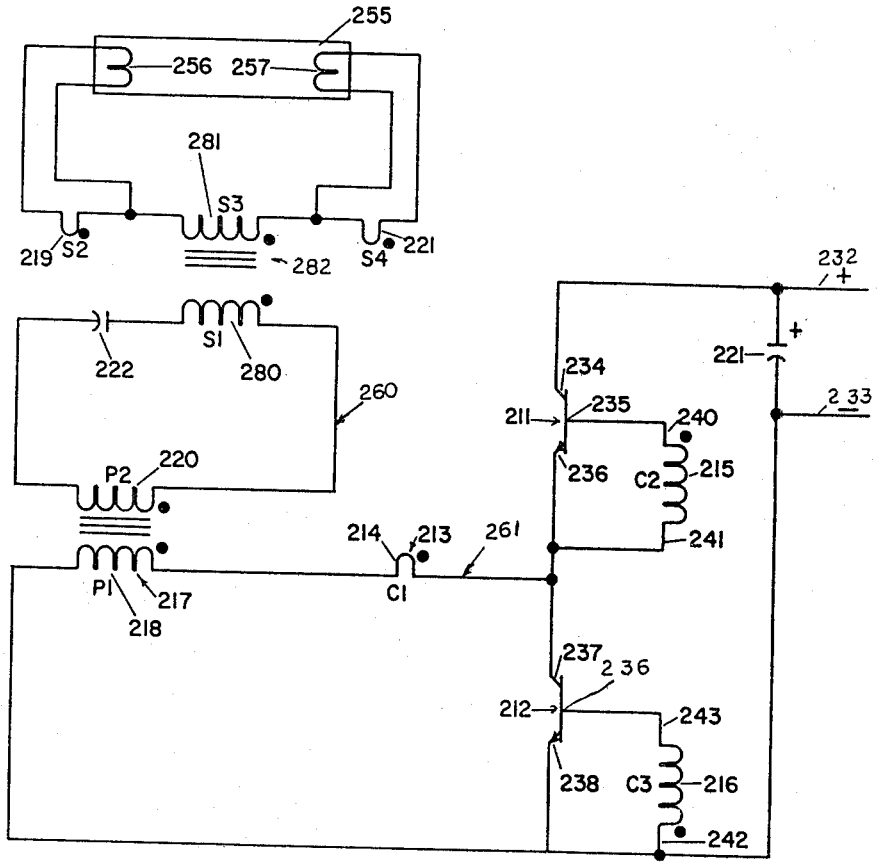
FIG. 5 shows a schematic view of another embodiment of the invention.

Now, with specific reference to the embodiment of the invention shown in FIG. 5, an alternate embodiment of the invention is shown wherein the resonant loop is indicated at 260 made up of the primary winding 280 of transformer 282 and the secondary winding 220 of transformer 217. Current transformer 213 is connected in series with primary 218 and to the line 241. Secondary winding 215 is connected to the base of the transistor 211 at 235 and the terminal 243 is connected to the base 236 of the transistor 212. The terminal 242 is connected to the line 233. The input to this circuit may be considered to be lines 232 and 233. Filter capacitor 221 is connected across the output of a full wave rectifier as in the other embodiments.

The corresponding parts of the embodiment in FIG. 5 have numbers similar to the corresponding parts on the other embodiments of the invention, and it will be seen that the oscillator used generates a high frequency voltage for driving the fluorescent lamp 255. When the power is applied to input terminals 232 and 233 out of the full wave rectifier, the input voltage is filtered by capacitor 221 and this voltage is applied to the network which includes transistor 211 and 212 causing transistor 211 to turn on. This starts current flowing in the loop which includes primary windings 214 and 218 which induces a voltage in the winding 220 which in turn starts a current flowing in the loop 260 and condensor 222 starts charging. Transformer 213 is used to sense current flow in the loop made up of windings 214 and 218 to synchronize the switching of transistors 211 and 212. When current is flowing into the winding 214 (dots on the drawing indicate instant polarity at a given time), current is flowing out of terminal 240 because the windings of transformer 213 are magnetically coupled. This turns transistor 211 on and turns transistor 212 off. When condensor 222 becomes fully charged, current passes through zero and reverses in condensor 222 loop, thus reversing the currents in the loop made up of windings 214 and 218. The reversal of current is sensed by the current transformer 213 which turns the transistor 211 off and turns transistor 212 on. Capacitor 222, through resonant action will transfer its charge to the opposite polarity again causing current to pass through zero and reverse in the capacitor 222 loop and in the loop made up of windings 214 and 218. The second reversal is sensed by transformer 213 which turns transistor 211 on and turns transistor 212 off. Transistor 211 and 212 are now maintaining resonance in capacitor 222 loop. This oscillating current and subsequent load is generated by this charging and discharging of capacitor 222 generating a voltage in primary winding 218. This voltage can be either stepped up or stepped down, depending on the requirements of the fluorescent light. The resonant frequency is set by capacitor 222 and inductance of primary windings 280 and the leakage inductance of secondary 220. The operation of this circuit will be generally like that in the circuit shown in the other embodiments of the invention; however, the resonant loop 260 is separate from the current monitoring loop 261.

FIG. 4 demonstrates a circuit where substantially equal energy is introduced into the circuit during each half cycle. This is accomplished by means of capacitors 133 and 133'. A similar effect may be accomplished by substituting a second source of energy for capacitor 133'.

The circuit described herein is illustrated using a fluorescent lamp application for example. There are many other examples where generating an unlimited ouput voltage could be utilized. Different types of high voltage lamp applications, ignition systems, and ignitors for rocket engines are other examples of the many which are only limited by the imagination of the designer.

Figure 6:
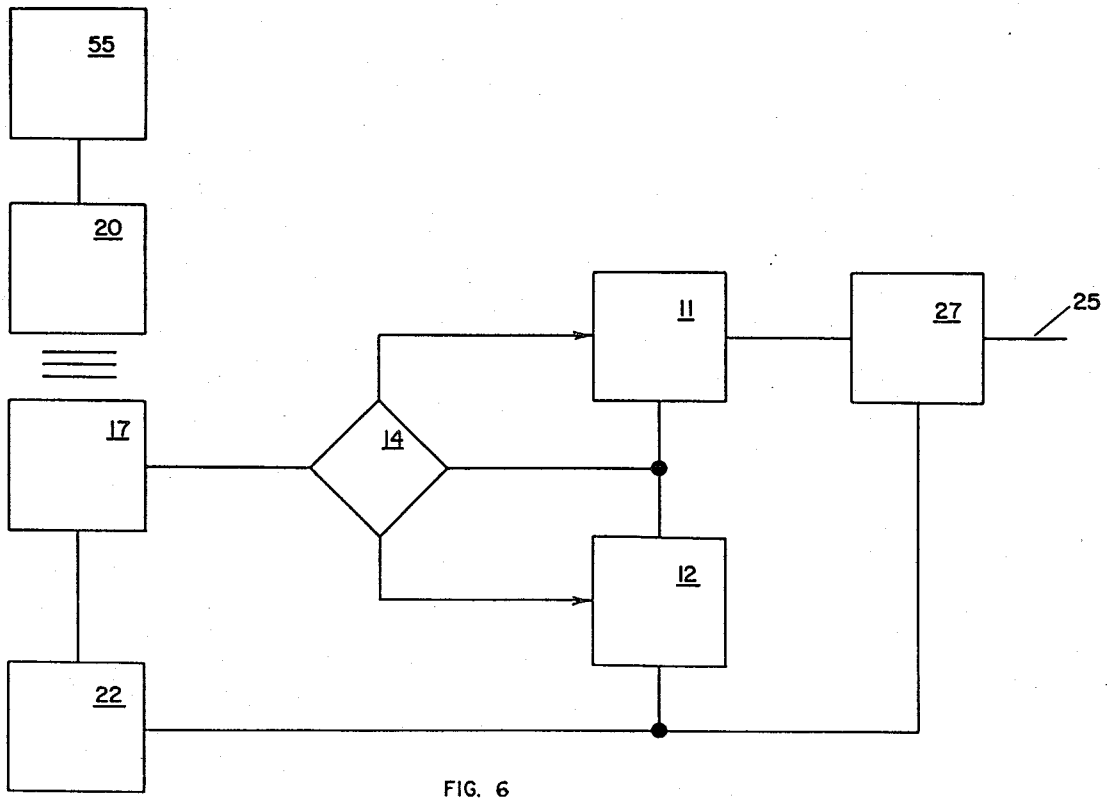
FIG. 6 is a block diagram of the invention.

With regard to the block diagram shown in FIG. 6, the numbers on the blocks correspond to the numbers shown in the embodiment of FIG. 1. In FIG. 6, load means 55 is shown connected to a load coupling means 20 which is magnetically coupled to the first magnetic means 18 which in turn is driven by the resonant capacity of means 22. Current monitoring means 14 is connected to the switching means 11 and 12 which in turn are connected to the DC source 27 which is supplied through the line 25.

The foregoing specification sets forth the invention in its preferred, practical forms but the structure shown is capable of modification within a range of equivalents without departing from the invention which is to be understood is broadly novel as is commensurate with the appended claims.

We claim:

1. A circuit for driving a load comprising,
a resonant circuit,
a power supply,
an inverter circuit,
control means for actuating said inverter,
a first transformer having a winding,
a second transformer having a primary winding, a first secondary winding and a second secondary winding, said primary winding having a few turns only,
a condenser,
a first electronic valve having an actuating means,
a second electronic valve having an actuating means,
said resonant circuit comprising said first transformer winding, said second transformer primary winding and said condenser connected in series with one another and adapted to carry resonant circuit current, said second transformer being a current transformer,
said inverter comprising said first electronic valve and said second electronic valve,
said first electronic valve being connected to said power supply and to said resonant circuit,
said second electronic valve being connected in series with said resonant circuit forming a loop,
said first secondary winding of said second transformer being connected to said actuating means on said first electronic valve,
said second secondary winding of said second transformer being connected to said actuating means of said second electronic valve,
said control means for actuating said inverter consisting of said second transformer,
said second transformer first secondary being adapted to actuate said first electronic valve connecting said power supply to said resonant circuit to charge said condenser to a first polarity,
said second transformer second secondary winding being adapted to actuate said second electronic valve connecting said resonant circuit into a loop allowing current to flow in said loop to charge said condenser to a second polarity,
and means on said circuit for connecting said first transformer winding to a load.

2. The circuit recited in claim 1 wherein said second transformer is a current transformer.

3. The circuit recited in claim 1 wherein said first transformer winding is primary winding and said means connecting said circuit to a load comprises a secondary winding on said first transformer.

4. The inverter circuit recited in claim 1 wherein said first transformer has a second secondary winding and a third secondary winding and said load means comprises a fluorescent lamp connected to said first secondary winding of said first transformer and having a first heater and a second heater,
said second secondary transformer winding of said first transformer being connected to said first heater means and said third transformer winding of said first transformer being connected to said second heater means on said fluorescent lamp,
said voltage in said secondary windings being adapted to reduce to a substantially low value during the time that the gas in said fluorescent lamp is ionized.

5. The circuit recited in claim 1 wherein said load is an ionizable gas lamp.

6. The circuit recited in claim 1 wherein said load is a fluorescent lamp.

7. The circuit recited in claim 5 wherein said fluorescent lamp has heating elements,
said second winding is connected to said heating means.

8. A circuit for driving a load comprising,
a resonant circuit,
a power supply,
an inverter circuit,
control means for actuating said inverter,
a first transformer having a winding,
a second transformer having a primary winding, a first secondary winding and a second secondary winding,
a condenser,
a first electronic valve having an actuating means,
a second electronic valve having an actuating means,
said resonant circuit comprising said first transformer winding, said second transformer primary winding and said condenser connected in series with one another and adapted to carry resonant circuit current,
said inverter comprising said first electronic valve and said second electronic valve,
said first electronic valve being connected to said power supply and to said resonant circuit,
said second electronic valve being connected in series with said resonant circuit forming a loop,
said first secondary winding of said second transformer being connected to said actuating means on said first electronic valve,
said second secondary winding of said second transformer being connected to said actuating means on said second electronic valve,
said control means for actuating said inverter consisting of said second transformer,
said second transformer first secondary being adapted to actuate said first electronic valve connecting said power supply to said resonant circuit to charge said condenser to a first polarity,
said second transformer second secondary winding being adapted to actuate said second electronic valve connecting said resonant circuit into a loop allowing current to flow in said loop to charge said condenser to a second polarity,
and means on said circuit for connecting it to a load,
said load is a fluorescent lamp,
said fluorescent lamp has heating elements, said second winding is connected to said heating means, said first transformer is a high leakage reactance transformer magnetically coupled to said secondary winding.

9. The circuit recited in claim 8 wherein said first transformer comprises a magnetic core in the form of a magnetic structure.

10. The circuit recited in claim 9 wherein said second transformer has a core made of a material having the magnetic properties of ferrite.

11. A circuit for driving a load comprising, a resonant circuit, a power supply, an inverter circuit, control means for actuating said inverter, a first transformer having a winding, a second transformer having a primary winding, a first secondary winding and a second secondary winding, a condenser, a first electronic valve having an actuating means, a second electronic valve having an actuating means, said resonant circuit comprising said first transformer winding, said second transformer primary winding and said condenser connected in series with one another, said inverter comprising said first electronic valve and said second electronic valve, said first electronic valve being connected to said power supply and to said resonant circuit, said second electronic valve being connected in series with said resonant circuit forming a loop, said first secondary winding of said second transformer being connected to said actuating means on said first electronic valve, said second secondary winding of said second transformer being connected to said actuating means of said second electronic valve, said control means for actuating said inverter consisting of said second transformer, said second transformer first secondary being adapted to actuate said first electronic valve connecting said power supply to said resonant circuit to charge said condenser to a first polarity, said second transformer second secondary winding being adapted to actuate said second electronic valve connecting said resonant circuit into a loop allowing current to flow in said loop to charge said condenser to a second polarity, and means on said circuit for connecting it to a load, said second transformer is a current transformer having an annular core made of a material having the properties of ferrite.

12. The circuit recited in claim 11 wherein second transformer has a core made of an annular member.

13. The circuit recited in claim 12 wherein said annular member has an opening there through and said windings wound on said annular member through said opening.

14. A circuit for driving a load comprising, a resonant circuit, a power supply, an inverter circuit, control means for actuating said inverter, a first transformer having a winding, a second transformer having a primary winding, a first secondary winding and a second secondary winding, a condenser, a first electronic valve having an actuating means, a second electronic valve having an actuating means, said resonant circuit comprising said first transformer winding, said second transformer primary winding and said condenser connected in series with one another, said inverter comprising said first electronic valve and said second electronic valve, said first electronic valve being connected to said power supply and to said resonant circuit, said second electronic valve being connected in series with said resonant circuit forming a loop, said first secondary winding of said second transformer being connected to said actuating means on said first electronic valve, said second secondary winding of said second transformer being connected to said actuating means of said second electronic valve, said control means for actuating said inverter consisting of said second transformer, said second transformer first secondary being adapted to actuate said first electronic valve connecting said power supply to said resonant circuit to charge said condenser to a first polarity, said second transformer second secondary winding being adapted to actuate said second electronic valve connecting said resonant circuit into a loop allowing current to flow in said loop to charge said condenser to a second polarity, said second transformer primary has a single turn.

* * * * *